United States Patent [19]

Thaler et al.

[11] Patent Number: 4,492,241

[45] Date of Patent: Jan. 8, 1985

[54] RETRACTABLE CURLING BRUSH

[75] Inventors: Arnold Thaler, Plantation; David Friedson, Miami, both of Fla.; Lai Kin, Kowloon, Hong Kong

[73] Assignee: Windmere Corporation, Hialeah, Fla.

[21] Appl. No.: 350,185

[22] Filed: Feb. 19, 1982

[51] Int. Cl.[3] ..... A45D 2/24

[52] U.S. Cl. ..... 132/37 R; 219/222

[58] Field of Search ..... 132/40, 33, 42, 34 R, 132/39, 37 R, 117, 118, 11 R, 11 A, 9, 150, 123; 219/222

[56] References Cited

U.S. PATENT DOCUMENTS

| | | | |
|---|---|---|---|
| 946,622 | 1/1910 | Thurman . | |
| 2,175,344 | 2/1939 | Friedman . | |
| 2,526,577 | 10/1950 | Renstrom et al. | 132/40 UX |
| 2,803,256 | 8/1957 | Lerner . | |
| 3,140,719 | 7/1964 | Hansen | 132/123 X |
| 3,161,202 | 12/1964 | Mecca . | |
| 3,275,007 | 9/1966 | Thackeray | 132/40 |
| 3,334,638 | 8/1967 | Behrens . | |
| 4,145,600 | 3/1979 | Walter et al. . | |
| 4,161,050 | 2/1979 | Sasaki et al. . | |
| 4,211,914 | 7/1980 | Jackson . | |
| 4,215,710 | 8/1980 | Sundin . | |
| 4,314,137 | 2/1982 | Dorn . | |
| 4,326,545 | 4/1982 | Motegi et al. . | |
| 4,327,753 | 5/1982 | Bertschi | 219/222 |
| 4,335,732 | 6/1982 | Megna | 219/222 |
| 4,368,376 | 1/1983 | Andis | 219/222 |

*Primary Examiner*—Gregory E. McNeill

*Attorney, Agent, or Firm*—Fleit, Jacobson, Cohn & Price

[57] ABSTRACT

A heated curling brush with retractable teeth for use in curling the hair. The curling brush includes inner and outer barrels with toothed comb members of a sufficient size for properly curling the hair and pivotally mounted within longitudinal slots in the inner barrel so that the teeth are capable of extending outwardly through apertures in the outer barrel. A source of heat is supplied through the inner barrel. Rotation of the outer barrel member results in the teeth of the comb members moving between an extended position in which each tooth extends perpendicularly to the exterior of the outer barrel for use in curling the hair and a retracted position within transverse recesses in the inner barrel for enabling the brush to be easily withdrawn from the hair. As the teeth are drawn into their retracted position, such action simultaneously serves to comb the hair thereby helping to facilitate the withdrawal of the brush.

19 Claims, 10 Drawing Figures

FIG. 1
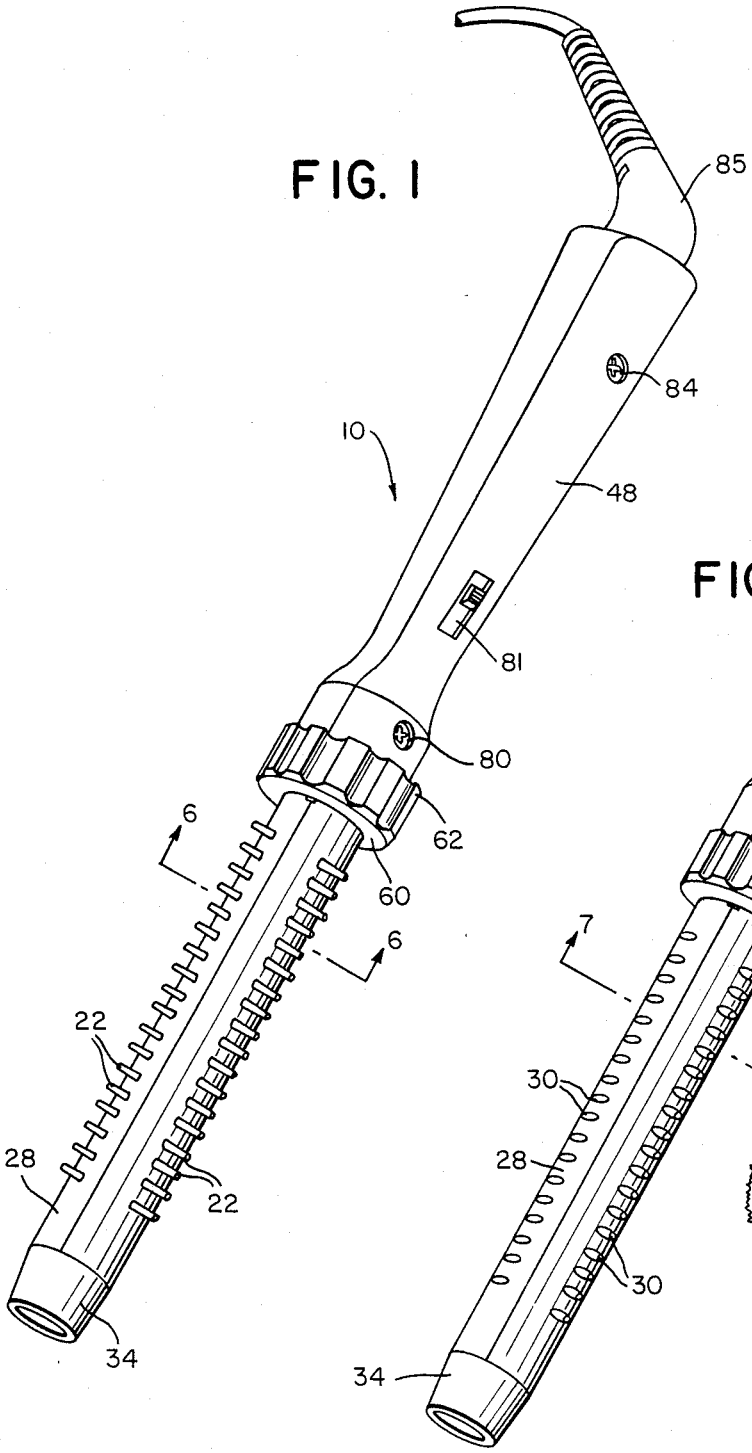
FIG. 2
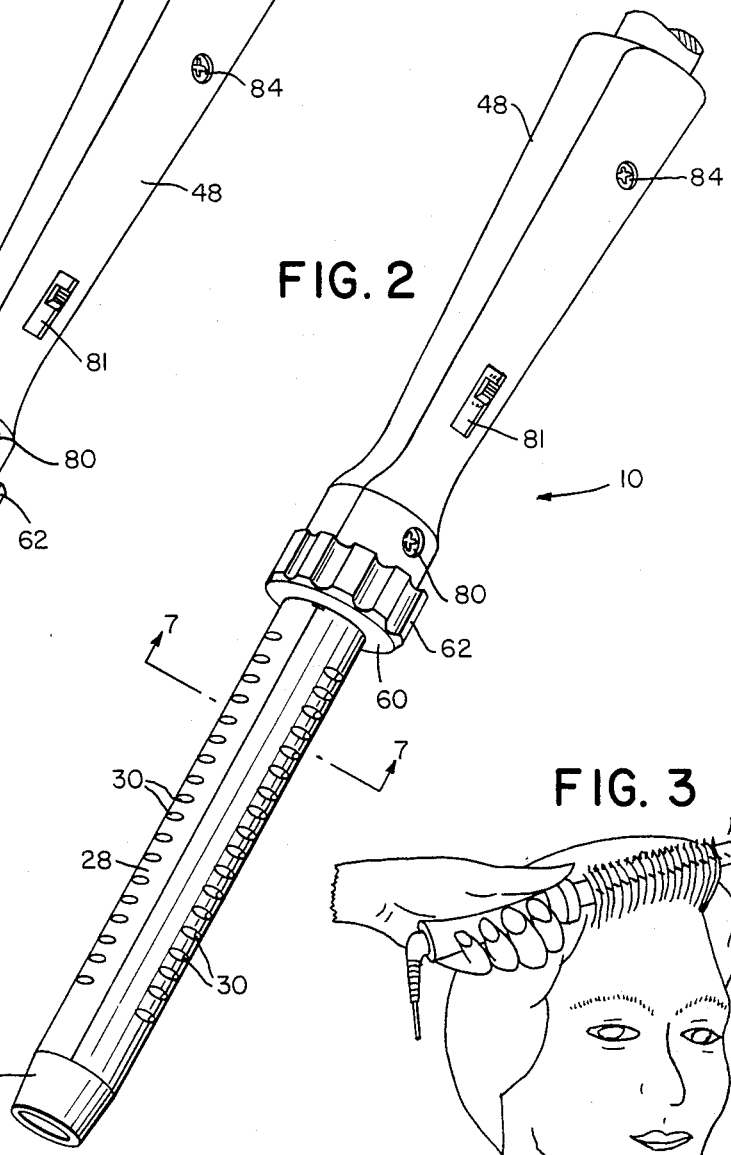
FIG. 3
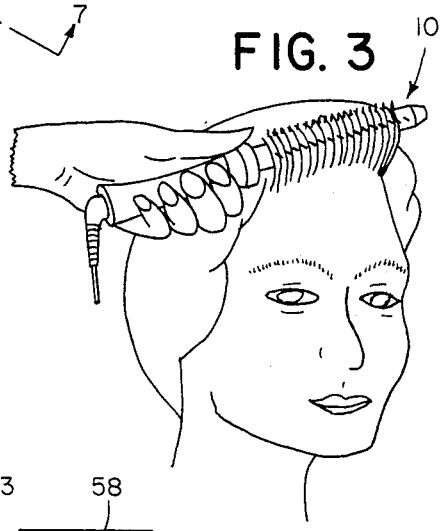
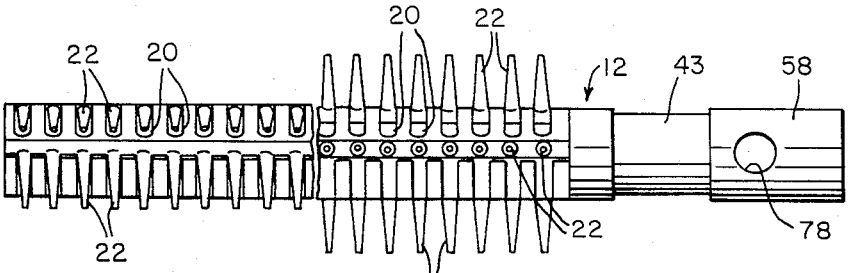
FIG. 5

OFF
ON

RETRACTABLE CURLING BRUSH

BACKGROUND OF THE INVENTION

The present invention relates to a curling brush for use in hair treatment. More particularly, the present invention relates to a curling brush having a retractable construction for the teeth thereof which provides a maximum curling effect to the hair, while permitting the brush to be used for forming curls but then easily withdrawn from the curls with a minimum of contact with the hair and producing a combing action upon retraction of the teeth.

When treating the hair to provide a curling effect, it is desirable to provide a construction for the hair curler which will retain the lock of hair in curled formation after the curling device is removed, while permitting the device to easily curl the hair and then be withdrawn from the hair with a minimum amount of contact with the hair so as not to disturb the curls.

A hair dressing device is described in U.S. Pat. No. 2,244,068 to Kay, in which the comb elements are freely and swingably mounted in cylindrical members provided at the end portions of the comb elements. The construction of such a device, however, is significantly different from that of the present invention which includes an improved and easily useable mechanism for extending and retracting the teeth, provides a continuous support for the teeth along the length of the inner barrel, and incorporates an improved mechanism for providing heat along the entire length of the inner barrel.

Another hair dressing comb is described in U.S. Pat. No. 4,191,200 to Renda, in which cam members and spring members are employed to project and retract the combs, similar to the operation of opening and closing an umbrella. A similar type of spring actuated retractable comb mechanism in a brush is currently marketed. The particular teeth of such marketed brush are very short which makes it difficult to form the curls. The actuating mechanism for retracting the teeth is both difficult to handle and creates a movement of the teeth that causes the teeth to become tangled in the hair.

Other U.S. Pat. Nos. illustrating various brushes with retractable combs are: 190,602; 411,028; 2,245,055; 3,148,685; 3,260,269 and 3,381,693.

SUMMARY OF THE INVENTION

It is an object of the present invention to provide an improved apparatus for curling the hair.

It is another object of the present invention to provide an improved retractable heated curling brush.

It is a further object of the present invention to provide a retractable heated curling brush which enables the user to wrap the hair around a central barrel member having teeth extending along the length thereof, and then to remove the teeth from contact with the hair in a sweeping combing action so that the teeth easily release the hair and the barrel then may be withdrawn from the curl without disturbing it, leaving the curl intact.

It is a further object of the present invention to provide an improved heated curling brush wherein the combs can be easily and readily retracted after forming the curl without tangling the hair for enabling the brush to then slide out of the curl.

It is still another object of the invention to provide an improved construction for the central barrel member of a curling brush, wherein the teeth of the brush are supported along the entire length of the brush, and with uniform heat being provided along the length of the barrel and around the circumference thereof.

In conjunction with the previous objects, it is an additional object of the present invention to provide an improved construction for extension and retraction of the teeth of a retractable curling brush in order to avoid the possibility of the hair becoming entangled as with previous curling brushes.

The present invention provides these and other desirable features in an improved retractable curling brush which enables the user to (a) wrap the hair around a central toothed barrel; (b) apply heat to the curl; and then (c) withdraw the teeth from contact with the hair without tangling with the hair so that the barrel then can be removed from the curl without disturbing it, thus leaving the curl intact. The retraction feature of the teeth of the present invention creates a combing action that completely eliminates the possibility of the hair becoming entangled in the brush as it does with previous curling brushes.

The retractable curling brush of the present invention includes an inner barrel member having a plurality of longitudinal slots located at intervals around the circumference of the barrel. A toothed comb member is pivotally mounted in each slot. Transverse recesses are provided in the inner barrel to receive the teeth of the comb members in the retracted positions. A pair of semi-cylindrical members having apertures through which the teeth can pass are mounted over the teeth so as to form an outer barrel. The inner and outer barrels and the teeth should be formed of a material capable of transferring heat to the hair, such as metal, e.g., aluminum or stainless steel, and certain plastics.

In a first embodiment of the present invention, the outer barrel is engaged at one end by a ring assembly which provides a means of rotating the outer barrel. By rotating the ring assembly in one direction, the outer barrel will bear against the teeth and provide a camming action which causes the teeth to assume a fully extended position. Upon rotation of the ring assembly in the opposite direction, the outer barrel will cause the teeth to pivot in the opposite direction, thus retracting the teeth into the transverse recesses provided in the inner barrel.

In a second alternative embodiment of the present invention, the teeth are movable between extended and retracted positions by the action of the outer barrel which moves longitudinally with respect to the handle. As the outer barrel is moved, the teeth are either drawn inwardly or projected outwardly.

In both embodiments of the present invention, as the teeth are retracted there is a combing action of the teeth throughout the hair. A heating element extends the length of the inner barrel in both embodiments and this element provides heat to the teeth as well as the outer barrel, thus enhancing the hair curling operation. The inner barrel is of a tubular construction with a central opening extending throughout its length for the heater wire. The inner barrel provides highly desirable characteristics of strength and heat transfer to the curling brush construction.

BRIEF DESCRIPTION OF THE DRAWINGS

FIG. 1 is a perspective view of the retractable curling brush of the present invention with the teeth in an extended position;

FIG. 2 is a perspective view of the curling brush of FIG. 1 with the teeth in a retracted position;

FIG. 3 is a diagrammatic drawing showing the curling brush of FIG. 1, with teeth extended, operatively engaged in curling hair;

FIG. 5 is a top plan view of the inner barrel of the curling brush of FIG. 1 with the teeth on the inner end portion of the barrel shown in an extended position and the teeth on the outer end portion of the barrel shown in a retracted position;

DESCRIPTION OF THE PREFERRED EMBODIMENTS

Figures 4, 6, 7:
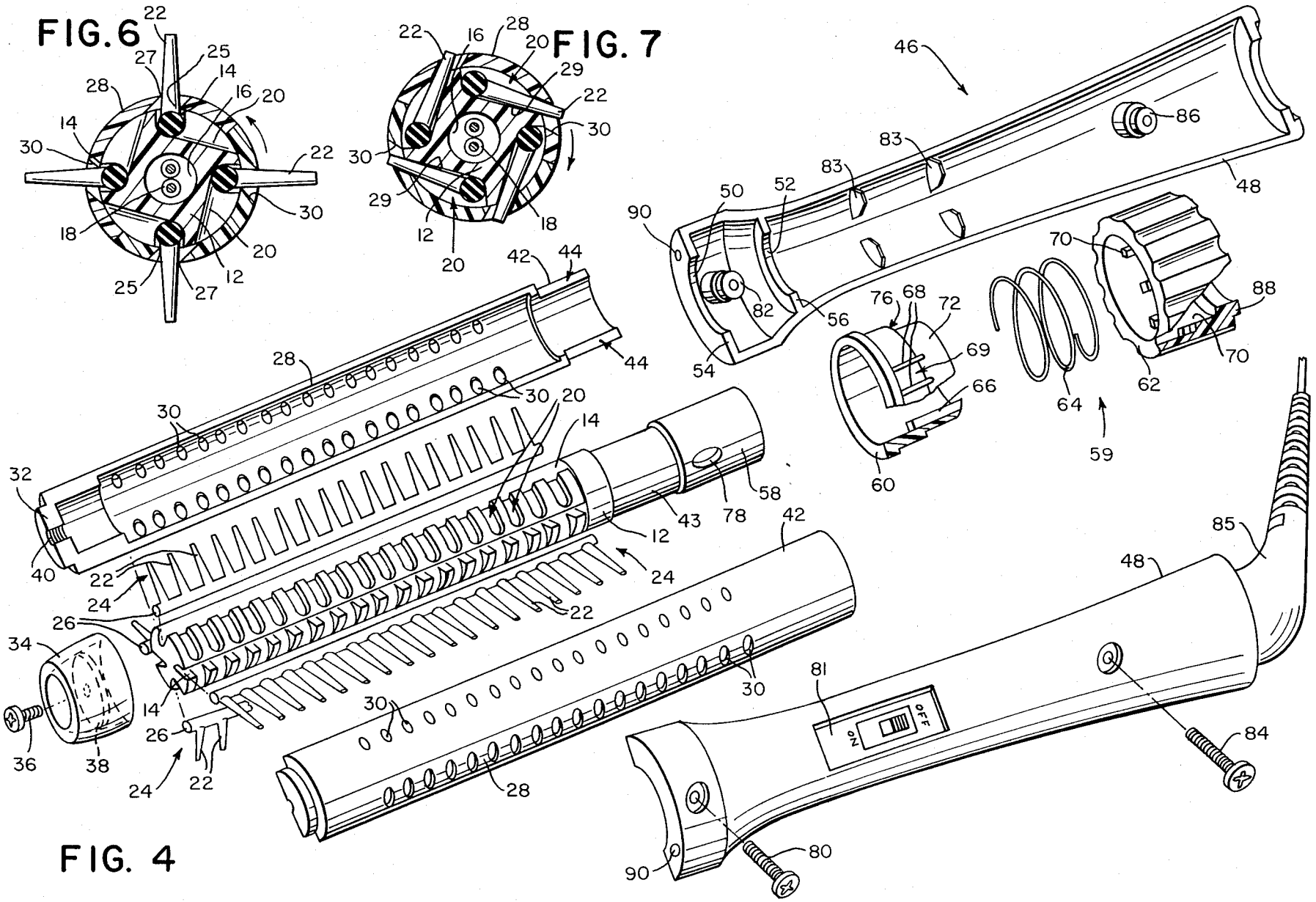
FIG. 4 is an exploded perspective view of the curling brush of FIG. 1.
FIG. 6 is a cross-sectional view taken along line 6—6 of FIG. 1.
FIG. 7 is a cross-sectional view taken along line 7—7 of FIG. 2.

In the embodiment of the invention as shown in FIGS. 1–8, there is provided a hair curling brush 10 having an inner barrel member 12 provided with a plurality of longitudinal slots 14 arranged circumferentially on the barrel 12. In one embodiment, these slots 14 are located at 90° intervals around the circumference of the barrel 12. The barrel 12 is formed of a suitable material such as cast aluminum, with a small central bore 16 extending the length thereof for receiving a heating element 18. The inner barrel 12 is also provided with a series of transverse recesses 20 for receiving the teeth 22 of the comb member 24 in the retracted position as described hereinafter. Both barrels as well as the teeth are all formed of a heat transferring material, such as aluminum, stainless steel and high temperature plastics.

A comb member 24 is positioned within each slot 14 so as to be pivotally mounted within the slot. Each comb member 24 has a longitudinally extending back portion 26 and a plurality of teeth 22 extending perpendicularly therefrom along the length of the back portion 26. Each of the teeth ideally is approximately ¼ to ½ inches long and preferrably about 5/16 inches long. The comb member 24 may be formed of a material such as high temperature plastic or a metal such as aluminum which will insure uniform heat transfer. The slots 14 are generally semicircular in cross-section, as shown in FIG. 6, of a diameter slightly larger than that of the longitudinally extending back members 26 of each comb 24, so that the comb members 24 will pivot freely within the slots 14.

A pair of semi-cylindrical members 28, of aluminum or other suitable heat transferring material, are provided with apertures 30. These apertures mate with the teeth 22 that extend from the slots 14. Semi-cylindrical members 28 fit over the teeth 22 and are arranged so as to be in close engagement with the inner barrel 12. The apertures 30 are positioned at an angle relative to the inner and outer surfaces of members 28, as shown in FIGS. 6 and 7, to assist in maintaining the teeth 22 in either the fully extended or fully retracted position. The inner diameter of the semi-cylindrical members 28 is substantially the same as the outer diameter of the inner barrel 12, and the members 28 thus define a rotatable outer barrel for the curling brush 10. The outer barrel 28 is provided with an indented portion 32 at its outer end, and an end cap 34 is secured to the indented portion 32 by means such as a screw 36 passing through a disc 38 molded into end cap 34, with the screw being secured in a threaded hole 40 in end portion 32. The inner end portion 42 of the outer barrel 28 is of reduced diameter to engage an indented portion 43 of the inner barrel 12, and the semi-cylindrical members 28 do not quite meet at these inner end portions 42, thus creating a pair of slots 44 at 180° intervals.

As shown in detail in FIGS. 4–7, the recesses 20 which receive the teeth 22 of a particular comb member 24 are all formed on a common side of the respective slots 14 and a separate recess 20 is provided for each tooth 22. In the embodiment shown, the recesses 20 are positioned so that rotation of the teeth 22 in a clockwise manner, as viewed from the outer end of the barrel 28, results in the teeth 22 being retracted. The pivoting movement of the teeth as they are retracted creates a combination which prevent the teeth from becoming entangled with the hair.

Figures 8, 9, 10:
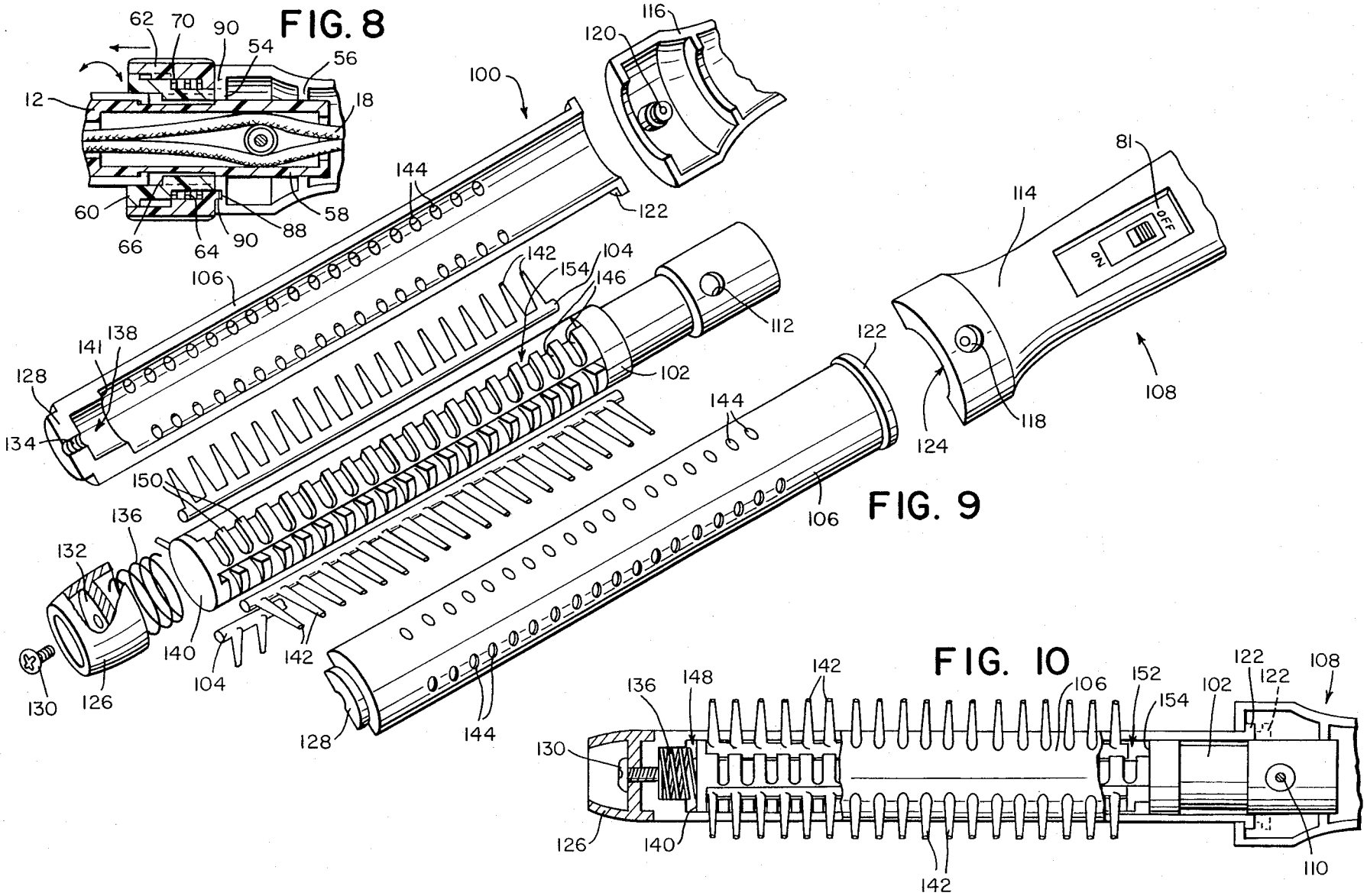
FIG. 8 is a cross-sectional view of the ring assembly employed in the operation of the curling brush of FIG. 1.
FIG. 9 is an exploded perspective view of an alternative embodiment of the curling brush of the present invention.
FIG. 10 is a side elevation, with some exterior members removed, of the curling brush of FIG. 9.

The handle 46 for the curling brush 10 is formed of a pair of semi-cylindrical members 48, of molded plastic or other suitable material, having inner transverse frame members 54, 56 with respective central openings 50, 52 to receive raised inner end portion 58 of the inner barrel 12, as shown in FIG. 8. The inner barrel 12 is secured to the handle 46 through the hole 78 in the raised portion 58 of the inner barrel 12, with attachment means such as a screw 80 extending from one of the handle members 48 through the hole 78 and being received in threads 82 located in the other handle member 48. Similar screw means 84 may be employed to secure the extreme end portion of the handle members 48, with the screw being received in threads 86.

The mechanism for operating the teeth 22 between the extended position shown in FIG. 6 and the retracted position shown in FIG. 7 is provided by a ring assembly 59 which includes an inner 60 and outer 62 ring, together with a spring 64, as shown in FIGS. 4 and 8. The inner ring 60 is of a size which allows it to fit over the inner end portion 42 of the outer barrel 28, which in turn engages the indented portion 43 of the inner barrel 12. A pair of lugs 66 located at 180° intervals on the interior surface of inner ring 60 fit within the slots 44 of the outer barrel 28, thus providing locations for the application of force to rotate the outer barrel 28 as the inner ring 60 is rotated. Two pairs of raised tabs 68 are located at 180° intervals on the exterior of inner ring 60, with each pair of tabs 68 defining a slot 69 to receive a corresponding lug 70 on the interior of the outer ring 62 when the outer ring 62 is moved forward toward the teeth 22. An indented portion 72 on the inner end 74 of ring 60, together with shoulder 76, serves to define a chamber for receiving spring 64, with outer ring 62 fitting over the spring 64 so that the lugs 70 are positioned within the slots 69 on the exterior of inner ring 60.

Spring 64 biases outer ring 62 away from the teeth into a locked position where it can not rotate inner ring 60. By moving outer ring 62 towards the teeth against the force of spring 64, ring 62 is unlocked (as further described below). Since lugs 70 of outer ring 62 engage slots 69 of inner ring 60 when the outer ring is unlocked, rotation of the outer ring will rotate the inner ring and in turn rotate the outer barrel. Rotation of the outer barrel causes pivoting of the comb member and the corresponding extension or retraction of the teeth such as shown in FIGS. 6 and 7.

Outer ring 62 is provided with a pin 88 which, upon rotation of ring 62, may be received into either of a pair of slots 90 located at 180° intervals on the inner face of the handle members 48 adjacent the ring assembly 59. Thus the application of pressure on outer ring 62 in a direction away from the handle 46 toward the teeth 22 unlocks outer ring 62 and with the rotation of outer ring 62, the outer barrel 28 will be caused to rotate for extending or retracting the teeth 22. When the outer ring 62 is in its locked position as the pin 88 engages one of the slots 90, the teeth 22 are locked in the fully extended or fully retracted position.

The angle of the apertures 30 relative to the inner and outer surfaces of the outer barrel 28 will result in the walls of the apertures 30 providing additional support for the teeth 22 in the extended position, while also assisting in retaining the teeth 22 in the retracted position. Generally the walls of the apertures 30 form an angle of about 45° with a tangent to the outer surface of the outer barrel 28. Thus in the extended tooth position, each tooth 22 will be supported on the side adjacent the respective recess 20 by the point of intersection 25 of the aperture 30 wall and the inner surface of the outer barrel 28, and on the opposite side the tooth 22 will be supported by the point of intersection 27 of the aperture 30 wall and the outer surface of the outer barrel 28, as shown in FIG. 6. In the retracted position, the walls of the apertures 30 are substantially parallel to the side wall 29 of the respective recess 20 along which each tooth 22 lies when in the retracted position as shown in FIG. 7. In one embodiment, the outer barrel 28 had a thickness of approximately 3/32"; the apertures 30 had a diameter of approximately ⅛"; the diameter of each tooth 22 at its base was approximately 3/32"; the length of each tooth 22 was approximately 5/16"; and the overall diameter of the outer barrel 28 was approximately ¾".

In the embodiment of the invention as shown in FIGS. 9 and 10, the basic structure of the hair curling brush 100 is the same as the embodiment of FIGS. 1-8, so far as the basic construction of the inner barrel 102, the comb members 104 and the outer barrel 106 are concerned. The inner barrel 102 is fixed to the handle 108 by attachment means such as a screw 110 which extends through hole 112 in the inner end portion of the inner barrel 102 and joins the semi-cylindrical handle members 114, 116 in a conventional manner at respective connection points 118, 120.

The outer barrel 106 is provided at its inner end with a raised rib 122 which is slidingly received inside the opening 124 provided at the forward end of the handle 108 for receiving the inner 102 and outer 106 barrel so that the rib 122 is retained within the handle 108, but with the capability for the outer barrel 106 to move in and out along the longitudinal axis of the hair curler 100, as shown by the dashed line position of the rib 122 in FIG. 10.

An end cap 126 is secured to the indented outer end portion 128 of the outer barrel 106 by screw means 130 which passes through disc portion 132 in the end cap 126 and into threaded portion 134 in the outer barrel 106. A spring 136 is retained within the cavity 138 between the indented portion 128 of the outer barrel 106 and the forward end 140 of the inner barrel 102.

In order to extend the teeth 142 of the comb members 104, the end cap 126 is rotated counterclockwise, as viewed from the outer end of the barrel 106, thus rotating the outer barrel 106 and causing the apertures 144 to bear against the teeth 142 which move from a retracted position within recesses 146 into a vertical extended position. Sufficient space 148 is provided in a longitudinal direction on the interior of the outer barrel 106 between the end 140 of the inner barrel 102 and the shoulder 141 adjacent cavity 138 so that the end cap 126 and outer barrel 106 may be moved forwardly, under the action of spring 136, to the position shown in FIG. 10, in which rib 122 abuts the inner surface of the handle 108 adjacent the opening 124 therein. In this position, the teeth 142 will have moved out of alignment with their respective recesses 146 in the stationary inner barrel 102 and the teeth 142 will now be aligned with the raised portions 150 located between successive recesses 146. Thus the teeth 142 will be effectively locked in the extended position, as rotation of the teeth 142 to the retracted position within recesses 146 is prevented by the raised barrel portions 150.

Space 152 is also maintained at the inner end of the slots 154 which receive the comb members 104 to allow the comb members 104 to move in a longitudinal direction sufficiently that the teeth 142 can move between a position in the recesses 146 and a position opposite the raised portions 150. The end member 140 of the inner barrel 102 provides a wall at the forward end of the slots 154 to prevent movement of the comb members 104 past the forward end of the inner barrel 102. As shown in FIG. 10, the end member 140 allows the comb members 104 to move forwardly only an amount which will position each tooth 142, when extended, opposite the raised postion 150 which is directly adjacent the respective recess 146 for each tooth 142.

In order to unlock the teeth 142 from the extended position, it is merely necessary to push rearwardly on the end cap 126 against the pressure of spring 136 a sufficient amount to realign the teeth 142 with the respective recesses 146, and the teeth 142 then may be retracted by rotation of the end cap 126 in a clockwise manner so that the teeth 142 are positioned within the recesses 146. The spring 136 tension should be sufficient to bias the teeth 142 forward to a position opposite the adjacent raised portions 150 when the teeth are released from the retracted position. The push-pull action and rotation of the end cap 126 as herein described can be accomplished with one hand while the other hand of the user grasps the handle 108 to maintain the hair curler 100 in a stationary position.

The heating element 18 is the same for the embodiments of FIGS. 1-10. Heating element 18 is a rope heating element, as shown in FIGS. 6-8 and extends throughout the length of the bore 16 within the inner barrel. Element 18 is connected to a conventional control switch 81 mounted within brackets 83 located on the interior of the handle 46, and the switch 81 is attached to an electrical conduit 85 for connection to a source of electric current. The rope element 18 is formed from any suitable heat conductive material, which is conventional in the art to which the invention pertains, and is generally about ⅛ to ¼ inch in diameter. Such heat conductive element 18 should be capable of transmitting heat uniformly to the body of the inner 12 and outer 28 barrel, as well as the teeth 22 of the comb members 24. As an alternative heating element 18, a solid state device in the form of a positive temperature coefficient (PTC) heater may be employed.

The curling brush of the present invention has been found to achieve all of the objects previously discussed, thus providing greatly improved results in the curling of hair as compared to previous curling brushes. Particular features, in addition to those previously described, include the feature whereby upon retraction of the teeth of the present brush, the teeth twist separately to create a combing action and actually release their grip on the hair, whereas prvious curling brushes tend to pull the hair downwardly during retraction, with the possibility of pulling the hair into the recesses into which the teeth are retracted. In addition, with the present brush, the length of the teeth significantly facilitates the curling of the hair. Thus, the curling brush of the present invention is a small barrel large teeth brush where the teeth are easily and readily retractable.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A retractable hair curling brush comprising: an inner barrel member having a plurality of longitudinally extending slots and a plurality of recesses extending from each slot transversely along the peripheral surface of said inner barrel member; a handle secured to one end of said inner barrel member; a toothed comb member pivotally mounted in each slot and oriented such that each tooth can be received by one of said recesses; an outer barrel member rotatably mounted around said inner barrel member, said outer barrel member having a plurality of apertures for receiving the teeth of combs; and means for rotating said outer barrel member so that the teeth of said comb members move between an extended position in which each tooth extends outwardly through said apertures of said outer barrel member and a retracted position within the transverse recesses of said inner barrel member with said teeth lying between said inner and outer barrel members, said means for rotating said outer barrel member comprising a ring assembly mounted on said outer barrel member, said ring assembly including; an inner ring mounted on said outer barrel for enabling rotation of said outer barrel with said inner ring; an outer ring mounted concentrically with the inner ring, said outer ring being movable between a locked and unlocked position; biasing means positioned between said inner and outer rings for biasing said outer ring into a locked position; said outer ring being longitudinally movable for unlocking said outer ring and said outer ring being rotatable when unlocked; and means for causing said inner ring to rotate with the outer ring when said outer ring is unlocked with rotation of said inner ring causing rotation of said outer barrel member.

2. The hair curling brush of claim 1 wherein said means for rotating said outer barrel member when retracting said teeth causes pivoting of said teeth for generating a combing action for facilitating withdrawal of said teeth from the hair without tangling the hair.

3. The hair curling brush of claim 1 or 2 wherein the means for rotating the outer barrel member comprises: means for moving the outer barrel member along the longitudinal axis of the curling brush; and means for biasing the outer barrel member with respect to the inner barrel for biasing said outer barrel member into a locked non-rotating position; and means for unlocking said outer barrel member by movement of said outer barrel member along the longitudinal axis of the curling brush and enabling said outer barrel member to be rotated for causing said teeth to move from a retracted position within the transverse recesses of the inner barrel member to an extended position perpendicular to the outer barrel with each tooth located opposite a respective outer surface portion of the inner barrel between successive recesses.

4. The hair curling brush of claim 1 or 2 wherein each comb member includes a longitudinally extending back portion and a plurality of teeth extending substantially perpendicularly from said back portion.

5. The hair curling brush of claim 1 or 2 wherein said recesses are substantially perpendicular to the longitudinal axis of the inner barrel member.

6. The hair curling brush of claim 1 or 2 wherein said slots are located at 90° intervals around the circumference of the barrel.

7. The hair curling brush of claim 1 or 2 wherein the apertures in said outer barrel member are formed with the side walls thereof inclined at an angle of about 45° with respect to a tangent to the outer surface of said outer barrel member.

8. The hair curling brush of claim 1 or 2 wherein each of said teeth in its extended position is supported by the respective said recess and by the point of intersection of the walls of said aperture in said outer barrel member.

9. The hair curling brush of claim 8 wherein when said teeth are in their retracted position, the walls of said apertures are substantially parallel to the side wall of the respective recess along which each tooth lies in said retracted position.

10. The hair curling brush of claim 1 wherein the inner and outer barrel members and the comb members are formed of a material capable of readily transferring heat, such as aluminum, stainless steel and high temperature plastics.

11. A retractable heated hair curling brush comprising: an inner barrel member having a plurality of longitudianally extending slots and a plurality of recesses extending from each slot transversely along the peripheral surface of said inner barrel member; a handle secured to one end of the inner barrel member; a toothed comb member pivotally mounted in each slot and oriented so that each tooth can be received by one of said recesses; an outer barrel member rotatably mounted around said inner barrel member, said outer barrel member having a plurality of apertures for receiving the teeth of said combs; means for rotating said outer barrel member so that the teeth of said comb members move between an extended position in which each tooth is extended perpendicularly to the exterior of said outer barrel member and a retracted position within the transverse recesses of the inner barrel with said teeth being pivoted as they are retracted for creating a combing action of said teeth through the hair, said means for rotating said outer barrel member comprising a ring assembly mounted on said outer barrel member, said ring assembly including: an inner ring mounted on said outer barrel for enabling rotation of said outer barrel with said inner ring; an outer ring mounted concentrically with the inner ring, said outer ring being movable between a locked and unlocked position; biasing means positioned between said inner and outer rings for biasing said outer ring into a locked position; said outer ring being longitudinally movable for unlocking said outer ring and said outer ring being rotatable when unlocked; and means for causing said inner ring to rotate with the outer ring when said outer ring is unlocked with rotation of said inner ring causing rotation of said outer barrel member; and means located in the inner barrel for providing heat to the branch.

12. The hair curling brush of claim 11 wherein the means for rotating the outer barrel member comprises: means for moving the outer barrel member along the longitudinal axis of the curling brush; and means for biasing the outer barrel member with respect to the inner barrel for biasing said outer barrel member into a locked non-rotating position; and means for unlocking said outer barrel member by movement of said outer barrel member along the longitudinally axis of the curling brush and enabling said outer barrel member to be rotated for causing said teeth to move from a retracted position within the transverse recesses of the inner barrel member to an extended position perpendicular to the outer barrel with each tooth located opposite a respective outer surface portion of the inner barrel between successive recesses.

13. The hair curling brush of claim 11 wherein each comb member includes a longitudinally extending back portion and a plurality of teeth extending substantially perpendicularly from said back portion.

14. The hair curling brush of claim 11 wherein said recesses are substantially perpendicular to the longitudinal axis of the inner barrel member.

15. The hair curling brush of claim 11 wherein the slots are located at 90° intervals around the circumference of the barrel.

16. The hair curling brush of claim 11 wherein the apertures in said outer barrel member are formed with the side walls thereof inclined at an angle of about 45° with respect to a tangent to the outer surface of said outer barrel member.

17. The hair curling brush of claim 11 wherein each of said teeth in its extended position is supported by the respective said recess and by the point of intersection of the walls of said aperture in said outer barrel member.

18. The hair curling brush of claim 11 wherein when said teeth are in their retracted position, the walls of said apertures are substantially parallel to the side wall of the respective recess along which each tooth lies in said retracted position.

19. The hair curling brush of claim 11 wherein the inner and outer barrel members and the comb members are formed of a material capable of readily transferring heat, such as aluminum, stainless steel and high temperature plastics.

* * * * *